US005564937A

United States Patent [19]

Herzog

[11] Patent Number: 5,564,937

[45] Date of Patent: Oct. 15, 1996

[54] LIGHT BULB SOCKET ASSEMBLY

[75] Inventor: Richard R. Herzog, Arlington Heights, Ill.

[73] Assignee: Illinois Tool Works Inc., Glenview, Ill.

[21] Appl. No.: 360,597

[22] Filed: Dec. 21, 1994

[51] Int. Cl.[6] ..... H01R 29/00

[52] U.S. Cl. ..... 439/170; 439/642

[58] Field of Search ..... 439/641, 642, 439/170, 171, 173, 217, 220, 306, 356

[56] References Cited

U.S. PATENT DOCUMENTS

| | | | |
|---|---|---|---|
| 1,585,109 | 5/1926 | Recker | 439/642 |
| 2,221,505 | 11/1940 | Benander | 439/642 |
| 2,462,530 | 2/1949 | Miller | 439/356 |
| 4,093,333 | 6/1978 | Tjornhom, Sr. | 439/306 |
| 4,440,467 | 4/1984 | Vologni et al. | 439/642 |

*Primary Examiner*—P. Austin Bradley
*Assistant Examiner*—Jeffrey T. Knapp
*Attorney, Agent, or Firm*—Schwartz & Weinrieb

[57] ABSTRACT

A light bulb socket assembly adapts a primary light bulb socket housing to accept a light bulb of a smaller size. The assembly includes a primary housing including desired electrical contacts and a bulb insert for mounting within the primary housing wherein the insert threadingly accepts a base portion of a light bulb and enables contact between the bulb and the electrical contacts. A connecting member is also included which releasably mounts the bulb insert to the primary housing and prevents removal of the bulb insert in the event the bulb is over-tightened.

18 Claims, 2 Drawing Sheets

FIG. 1
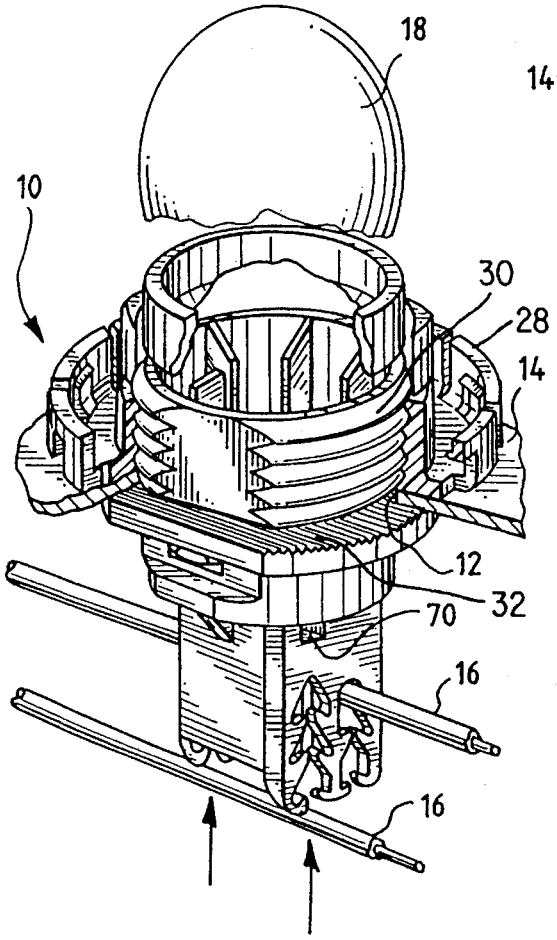
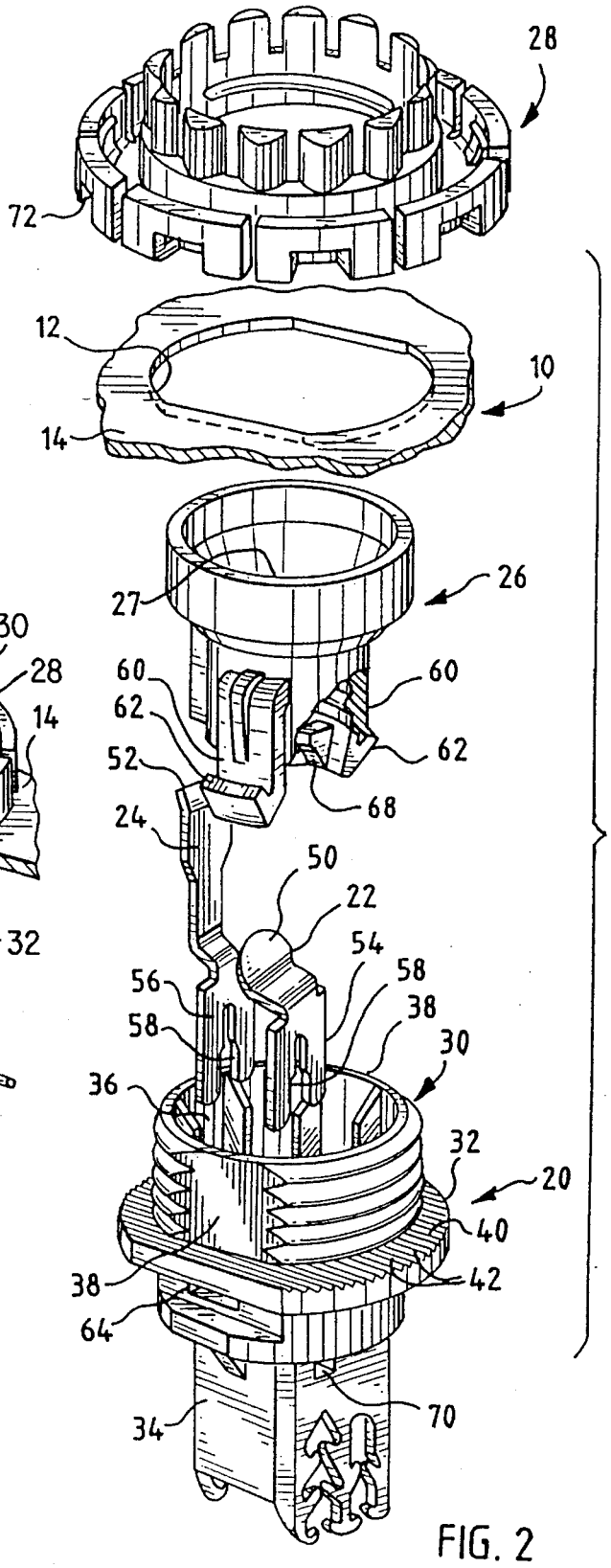
FIG. 2

FIG. 3
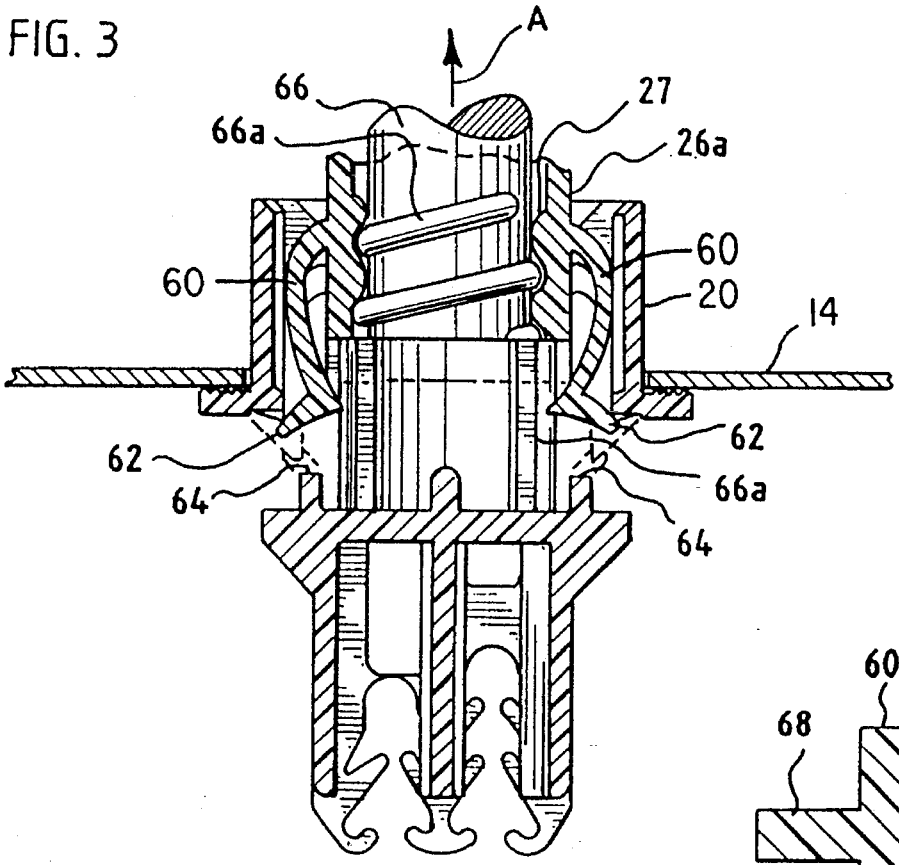
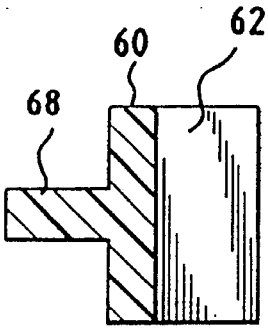
FIG. 5
FIG. 4
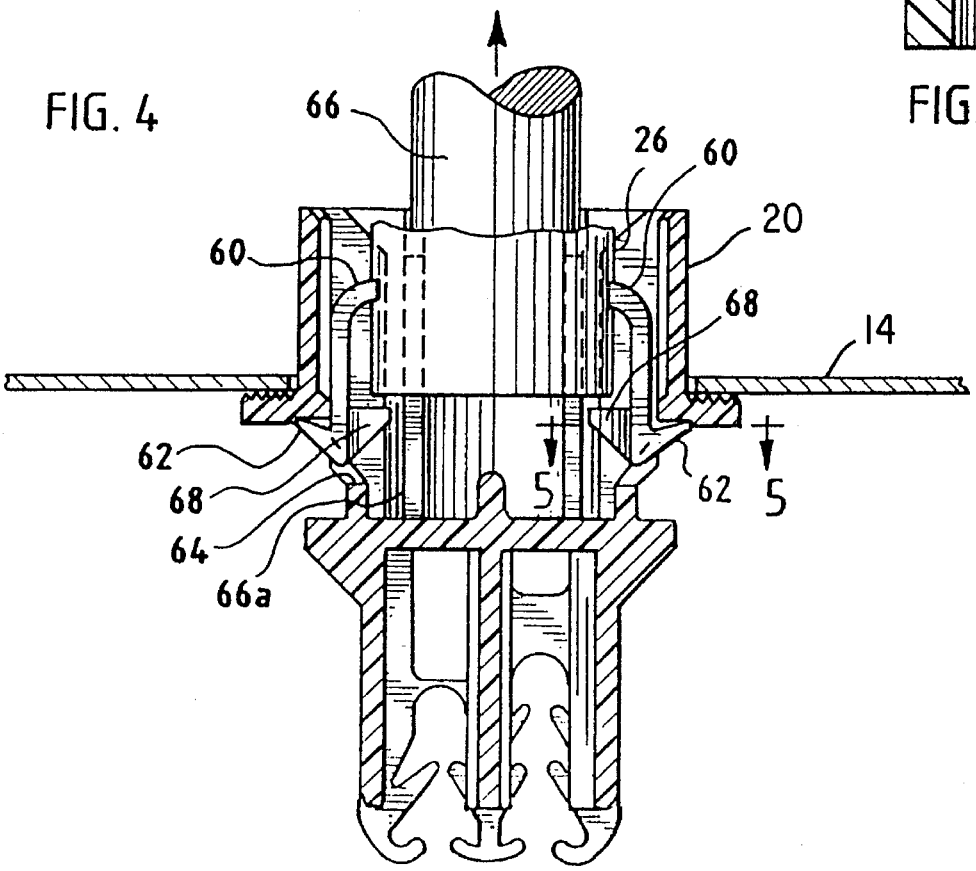

LIGHT BULB SOCKET ASSEMBLY

FIELD OF THE INVENTION

The present invention relates generally to light bulb sockets, and more particularly, to a light bulb socket assembly which is adaptable to threadingly accept two light bulb bases of two different size.

BACKGROUND OF THE INVENTION

In order to reduce confusion among consumers and provide uniformity between manufacturers, the light bulb and fixture industry was standardized some time ago. Such standardization primarily includes the size of the bulb and the threads which are formed on the base of the bulb and within the associated bulb socket and includes a number of bulb and socket sizes.

Typically, a particular bulb socket is designed to accommodate only one size light bulb. Thus, if a user, such as a manufacturer, requires different size light bulbs for different products, different size sockets must also be provided which adds significantly to assembly and inventory costs.

Additionally, light bulb sockets are typically mounted to other structures and are frequently mounted within an aperture of a panel. In such applications, the bulb extends from one side of the panel and is sometimes exposed to the elements while the associated wiring is contained on the opposite side of the panel and is substantially protected from the elements. Accordingly, the protruding bulb and socket portion must be weatherproof so as to prevent malfunctioning and reduce corrosion of the assembly.

It also is required that a particular bulb, socket, or both be replaced periodically due to wear or extended use. Bulb replacement can be hampered if the bulb base and socket become substantially adhered together, such as by corrosion between the materials used to form these components. It is also desirable to provide a socket that is readily removable from the panel for similar reasons.

It would therefore be desirable to provide a socket assembly which can be adapted for use with a number of different size light bulb bases, readily releasably secured to a panel and associated electrical wiring, and is substantially weatherproof so as to protect the assembly from the elements.

SUMMARY OF THE INVENTION

The present invention provides a socket assembly for a light bulb which enables a primary light bulb socket housing of a particular size to be adapted for use with one or more smaller sizes of light bulb bases by securing a desired smaller size bulb insert within the primary socket housing. Accordingly, significant savings in manufacturing, shipping, storage and installation costs can be realized by only having to provide a primary bulb socket housing and selected inserts rather than providing several socket housings, one each for a desired bulb base size.

The socket assembly includes a primary housing having electrical contacts secured thereto, a bulb insert, and connecting members for releasably connecting the bulb insert within a portion of the primary housing. The bulb insert preferably includes a threaded socket portion for threadingly accepting a base portion of a light bulb therein for operable communication with the electrical contacts of the primary housing for illuminating the light bulb as desired.

In order to prevent removal of the insert after a bulb is threadedly engaged therein, the connecting members include portions formed therewith which engage the base of the bulb and prevent removal of the insert. Additionally, the assembly preferably includes a retainer ring for threadingly engaging a portion of the primary housing to secure the assembly within an aperture of another member, such as a panel.

BRIEF DESCRIPTION OF THE DRAWINGS

Other features and advantages of the present invention will become readily apparent from the following description when considered in connection with the accompanying drawings in which like reference characters designate like or corresponding parts throughout the several views and wherein:

FIG. 1 is a perspective view, in partial section, illustrating a light bulb socket assembly of the invention secured within an aperture of a panel and with appropriate wiring being secured to the assembly;

FIG. 2 is an exploded perspective view of the light bulb socket assembly of the invention;

FIG. 3 is a cross-sectional view of an embodiment of a light bulb socket assembly of the invention secured within an aperture of a panel and illustrating removal of a bulb insert portion of the assembly in the event of extreme over-tightening of a test gauge or bulb within the bulb insert portion;

FIG. 4 is a cross-sectional view of another embodiment of a light bulb socket assembly of the invention, similar to FIG. 3, but illustrating a modification of the bulb insert portion of the assembly which prevents removal of the bulb insert portion as illustrated in FIG. 3; and FIG. 5 is an enlarged cross-sectional view of a portion of the bulb insert portion of the assembly taken along line 5—5 of FIG. 4 in the direction indicated by the arrows.

DESCRIPTION OF THE PREFERRED EMBODIMENTS

While the present invention is susceptible of embodiment in various forms, there is shown in the drawings and will hereinafter be described presently preferred embodiments, with the understanding that the present disclosure is to be considered as an exemplification of the invention, and is not intended to limit the invention to the specific embodiments illustrated.

For ease of description, the assembly of this invention is described in the normal, upright, operating position and terms such as upper, lower, horizontal and the like, are utilized with reference to this position. It will be understood, however, that the apparatus of this invention may be manufactured, stored, transported and sold in an orientation other than the position described.

Referring to FIGS. 1 and 2, a light bulb socket assembly is designated generally by the reference numeral 10. The assembly 10 is preferably secured within an aperture 12 of a panel 14 and includes appropriate wiring 16. It is to be understood, however, that the particular structure to which the assembly 10 is secured can vary and the assembly 10 can be used without being secured to another member if desired.

A light bulb 18 is typically threaded within the assembly 10 which provides illumination of the bulb 18 as desired. In some applications, a substantially translucent dome member (not illustrated) is secured to the assembly 10 so as to cover the bulb 18 and thereby protect the bulb 18 and/or provide a desired color of light.

As FIG. 2 illustrates, the assembly 10 substantially includes a primary housing member 20, a first positive electrical contact member 22, a second negative electrical contact member 24, a bulb insert member 26 and a retainer ring 28. The first and second electrical contact members 22 and 24 are formed from conductive material, such as metal, while the remaining portions of the assembly 10 are preferably formed from plastic. The particular materials utilized, as well as the size and shape of the components of the assembly 10 can vary so long as they function as described herein.

Briefly, in use, the assembly 10 is utilized to provide a string of lights preferably wired in series. To secure the assembly 10 to the panel 14, a top threaded collar portion 30 of the assembly 10 is inserted through the aperture 12 from the back side of the panel 14 until a shoulder portion 32 engages the back side of the panel 14.

The retainer ring 28, having a ring pad **28*a* which prevents exposed marking of the panel 14, is then inserted over the bulb insert 26 and threaded about the collar 30 thereby securing the panel 14 between the retainer ring 28 and the shoulder 32. The wiring 16 is then inserted within portions of the first and second electrical contacts 22 and 24 and the bulb 18 is threaded into the bulb insert 26**.

Upon activation of the electrical circuit, the bulb 18 is illuminated. If desired, a dome can be secured to a portion of the retainer ring 28 to protect the bulb 18 and/or provide a desired color to the light emitted from the bulb 18. Alternatively, the bulb 18 can be provided with its own color.

As described above, the housing 20 is formed in one-piece to include the threaded collar 30 and the shoulder 32 as well as a contact mounting portion 34 and an interior recess 36. The collar 30 is preferably formed to include substantially coarse threads for easy alignment and threading of the retainer ring 28 thereon.

Additionally, it is to be noted that some apertures 12 in electrical applications are not circular but are formed in what is known as a "Double-D" shape, as illustrated in FIG. 2, which includes two straight segments formed on opposite sides of the aperture 12. In order to mount the collar 30 within the Double-D aperture, the collar 30 also includes two straight planar portions 38 which prevent the assembly 10 from rotating within the aperture 12.

To grip the back side of the panel 14, a top side 40 of the shoulder 32 includes a plurality of ribs 42. The ribs 42 grip the panel 14 so as to resist rotation of the assembly 10 within the aperture 12, particularly if a circular aperture 12 is used.

The first and second electrical contacts 22 and 24 are formed from a conductive material, such as metal or any other material, and include bulb contact ends 50 and 52 and wire contact ends 54 and 56, respectively.

The bulb contact end 50 of the first contact 22, which is the positive contact, makes contact with a bottom portion of the base of the bulb 18 while the bulb contact end 52 of the second contact 24, which is the negative contact, makes contact with a side portion of the base of the bulb 18. It is to be understood that the particular shape, size and material of the first and second electrical contacts 22 and 24 can vary so long as they function as described herein.

The wire contact ends 54 and 56 of the electrical contacts 22 and 24 are formed so as to provide insulation displacement contact with the wires 16 once the wires 16 are inserted within slots 58 of each contact end 54 and 56. This type of connection assures electrical contact once the wires 16 are inserted and is much more reliable over time than other types of wire connections such as point contacts or the like.

The wires 16 are preferably inserted within the slots 58 with an insertion tool (not illustrated) which inserts the wires 16 to a desired position within the slots 58 so as to assure a good electrical connection therebetween. Alternatively, the wires 16 can be inserted by hand or with any other tool.

As FIG. 2 illustrates, the bulb insert 26 is inserted within the interior recess 36 of the primary housing 20 after the first and second contacts 22 and 24 are secured therein. The bulb insert 26 includes threads 27 for engagement with the bulb 18 and, to releasably connect the bulb insert 26 to the primary housing 20, the bulb insert 26 includes a pair of substantially flexible leg members 60, one each formed on opposite sides of the bulb insert 26.

The leg members 60 include barbs 62 formed on their distal ends for cooperative engagement within corresponding apertures 64 formed in the primary housing 20. Accordingly, upon insertion of the bulb insert 26 within the primary housing 20, the legs 60 flex inward and then expand outward so as to permit the barbs 62 to seat within the apertures 64 and substantially lock the bulb insert 26 within the primary housing 20.

FIG. 3 illustrates an embodiment of the bulb insert **26*a* which was initially developed and performs well under the majority of circumstances encountered during use of the assembly 10. During extreme testing of the bulb insert 26*a*, however, it was discovered that when a thread test gauge 66, which simulates the threads on the base of a bulb 18, was inserted within the bulb insert 26*a* and over-tightened, the bulb insert 26*a* tended to be expelled from the primary housing 20**.

The reason for the expulsion of the bulb insert **26*a* appears to be that the torque exerted from extreme over-tightening of the test gauge 66 caused the test gauge 66 to pull the bulb insert 20 in the direction of arrow "A" while the primary housing 20 was held stationary. The pulling force was sufficient to cause the legs 60 to flex inwardly so that they would be released from the apertures 64 of the primary housing 20 due to the clearance between the threads 66*a* of the test gauge 66 and the legs 60**.

It is to be noted that a typical user cannot exert enough force by hand in the direction of arrow "A" to remove the bulb insert **26*a* from the primary housing 20. The bulb insert 26*a* is preferably removed from the primary housing 20 by pushing the barbs 62 inwardly so as to release them from the apertures 64**.

Additionally, the torque needed to cause the legs 60 to disengage is quite high and normally will not be exerted by a user when inserting a light bulb 18.

Nevertheless, in order to prevent the above-described problem from occurring, the bulb insert 26 was provided with engagement ribs 68 as illustrated in FIGS. 2, 4 and 5. The engagement ribs 68 extend toward the interior of the bulb insert 26 and, as FIG. 4 illustrates, during over tightening of the test gauge 66, the ribs 68 engage the threads **66*a* of the test gauge 66**.

Accordingly, the legs 60 are prevented from flexing inwardly which in turn prevents the barbs 62 from disengaging from the apertures 64.

As FIG. 2 substantially illustrates, to construct the assembly 10, the electrical contacts 22 and 24 are first inserted within the interior recess 36 of the primary housing 20. The wire contact ends 54 and 56 of the contacts 22 and 24 extend through slots (not illustrated) formed within the bottom of the interior recess 36 and into the contact mounting portion 34 of the primary housing 20.

To secure the electrical contacts 22 and 24 to the primary housing 20, a tool (not illustrated) is inserted within apertures 70 formed in the primary housing 20 so as to bend tab portions (not illustrated) on the contacts 22 and 24 inwardly. Upon bending of such tab portions, the contacts 22 and 24 are locked within the primary housing 20.

Once the contacts 22 and 24 are secured within the primary housing 20, the bulb insert 26 or **26*a* is inserted within the interior recess 36 of the primary housing 20. When finally seated therein, the legs 60 flex outwardly so as to enable the barbs 62 to seat within the apertures 64 and lock the bulb insert 26 or 26*a* to the primary housing 20**.

It is to be noted that the above described assembly is typically provided by the manufacturer so that the assembly 10 is shipped in two pieces, one piece including the primary housing 20, contacts 22 and 24, and the bulb insert 26 or **26*a*, while the other piece merely includes the retaining ring 28**. This substantially reduces the number of parts to be shipped as well as the assembly time required at the job site which is a very important criteria to the customer since some applications include assembly in remote locations such as to an overhead sign or a ride in an amusement park or carnival.

Once on the job site, the bulb insert 26 and threaded collar 30 of the assembly 10 are inserted through the aperture 12 in the panel 14. The retaining ring 28 is then secured about the threaded collar 30 so as to secure the assembly 10 to the panel 14.

Next, the wires 16 are inserted within the slots 58 of the electrical contacts 22 and 24 so as to electrically connect the assembly 10 to a desired electrical circuit. A bulb 18 is then inserted within the bulb insert 26 and is engaged with the threads 27. If desired, a dome (not illustrated) can be secured within apertures 72 on the retaining ring 28.

When a bulb 18 burns out, the dome, if utilized, is removed and the bulb 18 is unscrewed and replaced. Since the threads 27 of the bulb insert 26 or **26*a* are formed from plastic, no corrosion occurs between the base of the bulb 18 and the threads 27 which enables easier removal of the bulb 18** since no adhesion by the corrosion occurs.

Once the bulb 18 is removed, the assembly 10 can be replaced if desired by removing the retaining ring 28 and the wires 16. A replacement assembly 10 can then be installed as described above.

Modifications and variations of the present invention are possible in light of the above teachings. It is to be understood that within the scope of the claims the invention may be practiced other than specifically described.

What is claimed is:

1. A socket assembly for a light bulb, comprising:

a primary housing having an internally threaded portion having a first predetermined size for threadingly accepting therein a first light bulb having a base portion of corresponding first predetermined size, and electrical contact means for operable communication with a desired electrical circuit;

bulb insert means having an internally threaded portion having a second predetermined size which is less than said first predetermined size of said internally threaded portion of said primary housing for threadingly accepting therein a second light bulb having a base portion of a second corresponding predetermined size which is less than said first predetermined size of said base portion of said first light bulb; and means for releasably mounting said bulb insert means within said internally threaded portion of said primary housing, wherein two different bulbs, each having a different sized base portion, can be respectively accommodated by means of an appropriately sized internally threaded portion within one of said primary housing and said bulb insert means of said socket assembly.

2. The socket assembly as defined in claim 1 wherein said bulb insert means are formed from a substantially non-corrosive material to prevent corrosive reaction with said base portion of said second light bulb.

3. The socket assembly as defined in claim 1 wherein said means for releasably mounting said bulb insert means include means for preventing removal of said bulb insert means from said primary housing in the event the second light bulb is over-tightened after being threaded within said bulb insert means.

4. A socket assembly as set forth in claim 3, wherein said means for releasably mounting said bulb insert means within said primary housing comprises:

aperture means formed within said primary housing; and flexible leg members integral with said bulb insert means and having barb means formed upon distal end portions of said flexible leg members for snap-engagement within said aperture means of said primary housing.

5. A socket assembly as set forth in claim 4, wherein said means for preventing removal of said bulb insert means from said primary housing comprises:

rib means formed upon said distal end portions of said flexible leg members and extending radially inwardly toward said base portion of said second light bulb for engaging said base portion of said second light bulb when said second light bulb is threadedly inserted within said bulb insert means.

6. The socket assembly as defined in claim 1 including means for releasably attaching said assembly to another member.

7. The socket assembly as defined in claim 6 wherein said means for releasably attaching enables attachment within an aperture of a panel.

8. A socket assembly as set forth in claim 6, wherein:

said another member comprises a panel having an aperture defined therethrough; and said means for releasably attaching said assembly to said panel comprises a flanged portion integral with said primary housing for engaging a first surface of said panel, and a retainer ring, threadedly engaged with an externally threaded portion of said primary housing, for engaging a second surface of said panel.

9. A light bulb insert for releasable mounting within a light bulb socket housing having an internally threaded portion having a first predetermined size for threadingly accepting therein a first light bulb having a base portion of a corresponding first predetermined size, comprising:

an insert member for insertion within said light bulb socket housing and including an interiorly threaded portion having a second predetermined size which is less than said first predetermined size of said internally threaded portion of said light bulb socket housing for threadingly accepting therein a second light bulb having a base portion of a second corresponding predetermined size which is smaller than said first predetermined first predetermined size of said base portion of said first light bulb; and means for releasably engaging said insert member within said light bulb socket housing so that said insert member can be readily mounted within and removed from said light bulb socket housing as desired, wherein two different light bulbs, each having a different sized base portion, can be respectively accommodated within an appropriately sized internally threaded portion within one of said insert member and said light bulb socket housing when said insert member is respectively mounted within and removed from said light bulb socket housing.

10. The light bulb insert as defined in claim 9 wherein said insert member is formed from a substantially non-corrosive material to prevent corrosive reaction with said base portion of said second light bulb.

11. The light bulb insert as defined in claim 9 including means for preventing removal of said insert member from said light bulb socket housing in the event said smaller size second light bulb is over-tightened within said insert member.

12. A light bulb insert as set forth in claim 11, wherein said means for releasably engaging said insert member within said light bulb socket housing comprises:

flexible leg members integral with said insert member and having barb means formed upon distal end portions of said flexible leg members for snap-engagement within aperture means formed within said light bulb socket housing.

13. A light bulb insert as set forth in claim 12, wherein said means for preventing removal of said insert member from said light bulb socket housing comprises:

rib means formed upon said distal end portions of said flexible leg members and extending radially inwardly toward said base portion of said second light bulb for engaging said base portion of said second light bulb when said second light bulb is threadedly inserted within said insert member.

14. A socket assembly for light bulbs, comprising:

a light bulb socket housing having an internally threaded portion having a first predetermined size for threadedly accommodating therein a first light bulb having a base portion of a corresponding first predetermined size, and electrical contact means for operable communication with a desired electrical circuit;

a light bulb insert member, having an internally threaded portion having a second predetermined size which is less than said first predetermined size of said internally threaded portion of said light bulb socket housing, for threadedly accommodating therein a second light bulb having a base portion of a second corresponding predetermined size which is less than said first predetermined size of said base portion of said first light bulb; and means defined upon said light bulb socket housing and said light bulb insert member for releasably mounting said light bulb insert member within said light bulb socket housing and for permitting said light bulb insert member to be removed from said light bulb socket housing, wherein two different light bulbs, each having a different sized base portion, can be respectively accommodated within an appropriately sized internally threaded portion of one of said light bulb socket housing and said light bulb insert member of said socket assembly when said light bulb insert member has been removed from said light bulb socket housing and when said light bulb insert member has been mounted within said light bulb socket housing.

15. A socket assembly as set forth in claim 14, wherein said means for releasably mounting said light bulb insert member within said light bulb socket housing comprises:

aperture means defined within said light bulb socket housing; and flexible leg members integral with said light bulb insert member and having barb means formed upon distal end portions of said flexible leg members for snap-engagement within said aperture means of said light bulb socket housing.

16. A socket assembly as set forth in claim 14, wherein:

said light bulb insert member is fabricated from a substantially non-corrosive material so as to prevent corrosive adhesion with said base portion of said second light bulb.

17. A socket assembly as set forth in claim 14, further comprising:

means for securely mounting said socket assembly upon a support panel.

18. A socket assembly as set forth in claim 17, wherein said means for mounting said assembly upon said support panel comprises:

a flanged portion, integral with said light bulb socket housing, for engaging a first surface of said panel;

said light bulb socket housing including a collar portion for extending through an aperture defined within said support panel; and a retainer ring, threadedly engaged with an externally threaded portion of said collar portion of said light bulb socket housing, for engaging a second surface of said support panel.

* * * * *